US005886339A

United States Patent [19]

Wilson

[11] Patent Number: 5,886,339

[45] Date of Patent: Mar. 23, 1999

[54] MISSILE ATTITUDE SAFING SYSTEM

[75] Inventor: Robert R. Wilson, Chillum, Md.

[73] Assignee: The United States of America as represented by the Secretary of the Navy, Washington, D.C.

[21] Appl. No.: 423,641

[22] Filed: Dec. 28, 1964

[51] Int. Cl.[6] ..... F42C 11/06; F42C 15/44

[52] U.S. Cl. ..... 244/3.2; 102/264; 102/206; 102/215

[58] Field of Search ..... 102/71, 76, 82, 102/70.2, 264, 206, 215, 200; 244/14 K, 3.2; 74/5, 5.22, 5.6

[56] References Cited

U.S. PATENT DOCUMENTS 3,073,550 1/1963 Young ..... 244/3.11
3,086,468 4/1963 Mountjoy et al. ..... 102/216

*Primary Examiner*—Charles T. Jordan
*Assistant Examiner*—Christopher K Montgomery

[57] ABSTRACT

An attitude sensing safing system for a missile, which senses an attitude error of the missile, and activates a dudding signal when the error exceeds a certain value for a predetermined time. The missile includes a delay arming timer, which is deactivated when by the dudding signal. The system allows the missile to correct itself, by requiring that the error signals persist for a set time.

7 Claims, 3 Drawing Sheets

MISSILE ATTITUDE SAFING SYSTEM

The invention described herein may be manufactured and used by or for the Government of the United States of America for governmental purposes without the payment of any royalties thereon or therefor.

This invention relates to the art of the arming of ordnance missiles. More particularly, the invention relates to a safety arming system for a rocket propelled missile having a warhead, the system providing for dudding the warhead in the event that abnormal attitude conditions occur.

The present invention was developed as part of the SUBROC weapon system although it will be clear from the detailed description to follow that it is not limited to that particular weapon but has application to other missiles as well. In order to provide the maximum degree of safety to the launching submarine, many condition responsive arming devices are used in the SUBROC missile, among other things, an anti-circular run dudding capability is necessary to protect the launching submarine from a wayward missile. Moreover, because of the high degree of maneuverability of this weapon the missile may on occasion greatly exceed the normal conditions of attitude and then recover and continue properly on to the target. To be satisfactory, a dudding system must permit this kind of operation.

Prior systems for accomplishing a dudding or self-destroying function responsive to abnormal attitude conditions employed specially designed gyros having stop contacts therein which would be closed to provide a dudding signal when the desired dudding angle was reached. Clearly, with this kind of a system, dudding occurs instantly upon the closure of the stop contacts. This result cannot be tolerated in a weapon such as SUBROC which, as noted above, has a high degree of maneuverability. A further disadvantage with the old dudding systems is that contact of the gyro with the stop contacts immediately destroys the inertial reference due to the precession torques generated by the contact closure forces. Accordingly, in this system whenever the attitude limits are reached or passed, the missile becomes a dud, no time being allowed for a temporary excursion of the missile past the dudding limits. Moreover, even if some delay means were used to prevent dudding at the instant of contact closure, the loss of inertial reference in the gyro is sufficient to render the system inoperative.

Thus it is an object of the present invention to overcome these disadvantages of the prior art by providing an attitude safety arming system which uses a standard design gyro which requires no special mechanical modifications and which has no special mechanical stops so that it does not lose the inertial reference when the missile momentarily exceeds the predetermined dudding limits. In standard practice, such a gyro does have an inner gimbal stop located at about 80° displacement, but its presence does not affect the operation of the present device.

Another object of the invention is to provide an attitude safety system for a rocket propelled missile which will not dud instantaneously when the dudding limits are reached but allows some time for the missile to recover.

A further object of the invention is to provide a system of the type mentioned above which will have more than one set of dudding limits so that the limits may be adjusted to be wide during the early portion of the flight of the missile to allow for vigorous maneuvering and turns, and to narrow the dudding limits after a predetermined time to provide for greater safety.

The objects of the invention are achieved by utilizing a standard two-degree-of-freedom displacement gyro having an ordinary synchro output, combined with an electronic system for measuring the output of the gyro and providing an output signal to the primary arming mechanism of the missile in the event that excessive attitude conditions occur for a predetermined minimum time. The electronic measuring circuit used here may take several forms but is preferably one similar to the signal-time comparison circuit disclosed in patent application Ser. No. 50,554 of James E. Swanekamp and Robert R. Wilson, filed Aug. 18, 1960. This system has been termed a pitch and yaw programmer. The output of the programmer is employed to open the power circuit of an electrically operated delay arming timer in order to prevent the arming switches from closing in the event that abnormal attitude conditions persist. The circuit has provision for changing the dudding limits after a predetermined time.

Other objects, advantages and new features of the present device will become apparent from a consideration of the detailed description when considered in conjunction with the accompanying drawing wherein.

Figure 1:
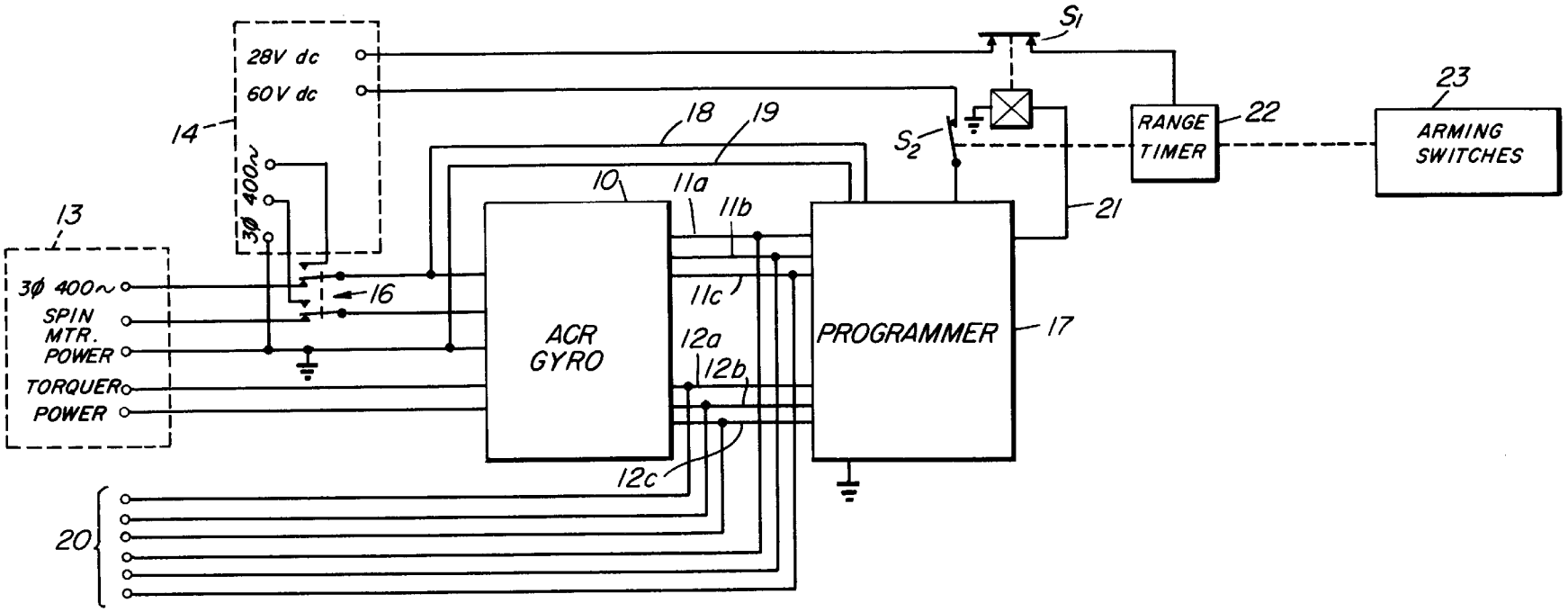
FIG. 1 is a functional block diagram of the present safety system.

The general arrangement of the invention is shown in FIG. 1. Gyro 10 is a standard two-degree-of-freedom gyro having a synchro transmitter on each of its outer and inner gimbals. The leads extending from one synchro are shown at 11*a*, 11*b* and 11*c*, and the leads extending from the other synchro are shown at 12*a*, 12*b* and 12*c*, respectively. A.C. power for the Gyro spin motor and synchros is supplied either from the fire control system 13 or from the missile power supply 14 depending upon the position of switch 16. The missile power supply also provides 28 volt d.c. and 60 volt d.c. power for a purpose to be later described. The gyro outputs go to the programmer 17, the details of which will be given with reference to FIG. 2, where they are measured by means of suitable control transformers, the outputs of which are combined with a reference voltage derived from the power supply over leads 18 and 19 for a purpose to be described below. Leads 20 are also provided so that the fire control system in the submarine can monitor the voltages from the gyro during the period prior to launch, to enable the gyro to be set to the desired heading.

As stated above, the programmer will provide an output in the event that the error signals indicative of excessive missile attitude conditions exceed a sequence of predetermined values for a predetermined time. If the excessive attitude condition is present for a sufficient time, the dudding output will appear on lead 21 of the programmer which is connected to an explosive switch $S_1$ in the power circuit of a range timer 22. Range timer 22 is an electrically operated delay arming timer which is mechanically connected to a series of primary arming switches, identified at 23 in FIG. 1, and is preset prior to launching the missile to close the arming switches after a predetermined time delay. Thus, in the event that switch $S_1$ is actuated by the attitude safing system of the present invention at a time prior to the expiration of the arming delay, the switch will open to remove the power from the range timer, in turn stopping it and preventing arming of the weapon.

Provision is also made for disabling the programmer in the event that it does not produce a dudding signal prior to the arming time. For this purpose, a switch $S_2$ is provided in the 60 volt power lead to the programmer 17. Switch $S_2$ is mechanically connected to range timer 22 and will be opened at the same time as the arming switches are closed.

Figure 2:
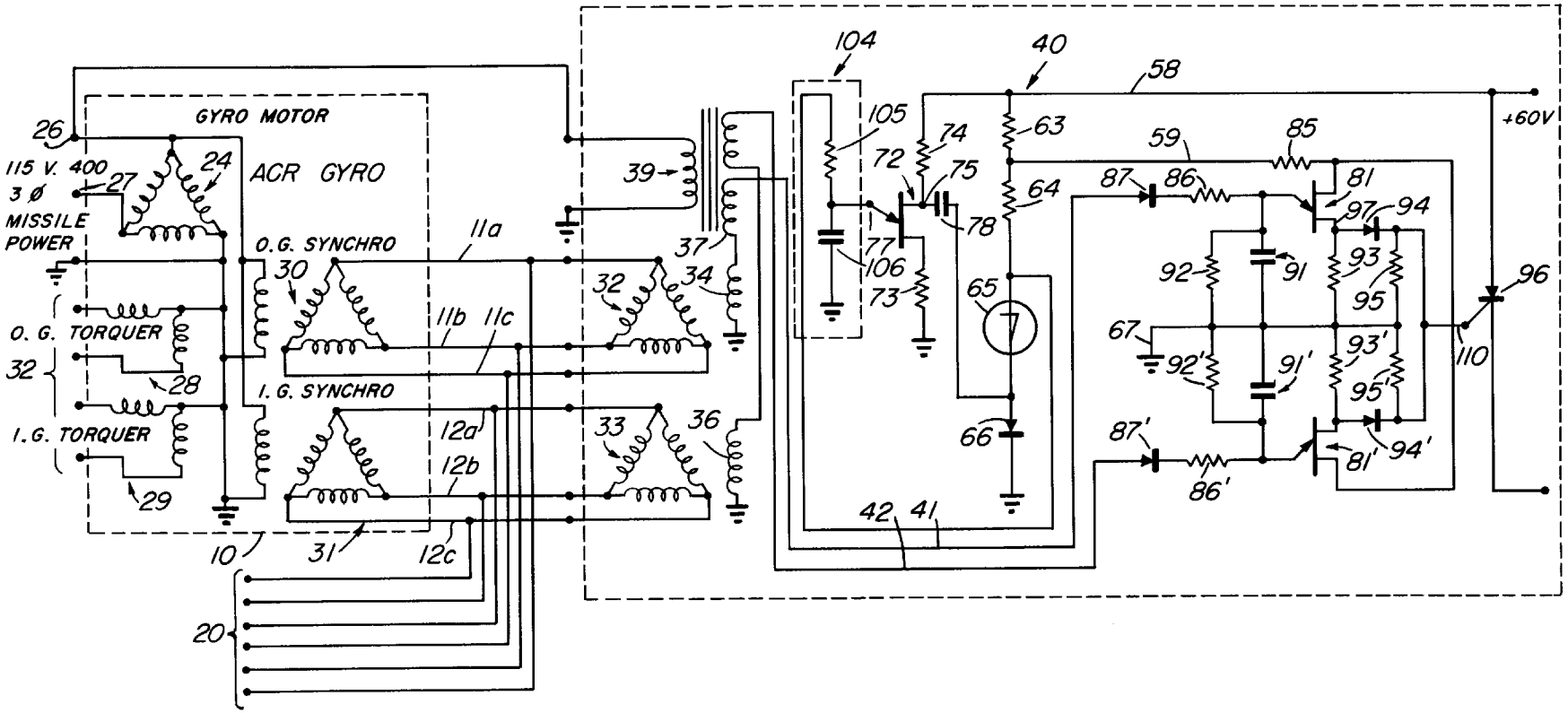
FIG. 2 is an electrical schemmatic showing the electrical interconnection between the gyro and the programmer of the present device.

Referring now to FIG. 2, the electrical details of the gyro and programmer will be described. The anti-circular-run gyro 10 is a conventional two-degree-of-freedom gyro having no specific mechanical modifications. As noted above, the gyro may have the conventional inner gimbal stop at about 80° displacement, but this is outside the normal operating range of the system. The gyro consists of a gyro motor 24 operated from the missile power supply through terminals 26, 27, and ground, an outer gimbal torque motor 28, an inner gimbal torque motor 29, an outer gimbal synchro transmitter 30 and an inner gimbal synchro transmitter 31. The torque motors 28 and 29 are actuated by the fire control system and are used to erect the gyro to the desired orientation prior to launch. The gyro is erected to orient the spin motor axis so that it is horizontal in the pitch plane and parallel to a line from the launcher to the target in the yaw plane, in order to provide a pitch reference and a target heading reference in the missile arming system.

Programmer 17 contains two control transformers 32 and 33, which are electrically connected to synchros 30 and 31 in conventional manner. The rotors 34 and 36 of control transformers 32 and 33, respectively, are fixed in position with respect to the stators thereof and are initially adjusted to a position such that voltages are induced therein which are of maximum magnitude and 180° out of phase with the driving voltage on the synchro transmitters when they are at their zero reference positions. Rotors 34 and 36 are connected in series relationship with secondary windings 37 and 38, respectively, in a transformer 39 driven from the same power supply as are the synchro transmitters. The voltage obtained from secondaries 37 and 38 is chosen to be equal in magnitude to the maximum voltage obtainable from the respective control transformers.

Figure 3:
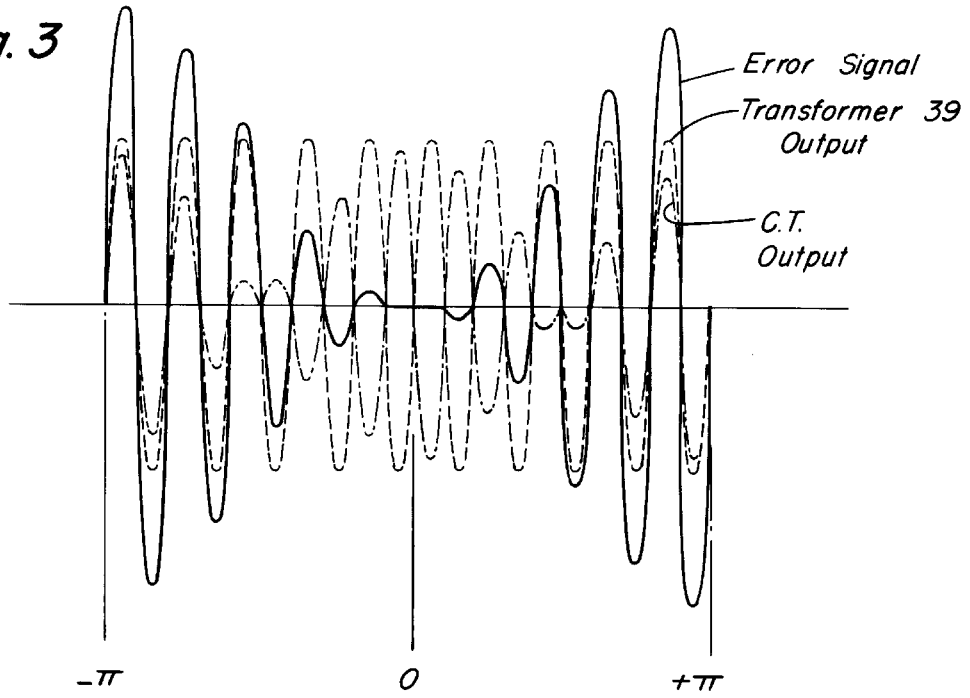
FIG. 3 is a graph of voltage vs. angular displacement, to explain the deviation of the error signal; and, FIG. 4 is a graph of voltage vs. time, illustrating the operation of the invention.

FIG. 3 illustrates the operation of control transformers 32 and 33 in combination with transformer 39 to produce the error signal. FIG. 3 is a plot of voltages against the angular displacement of the rotors of the synchros 30 and 31. As stated above, the rotors of control transformers 32 and 33 are initially oriented such that the zero position of the corresponding synchro results in the maximum induction in the rotors 34 and 36 in the out-of-phase sense. This is illustrated by the curve labeled "C.T. output" in FIG. 3 which is shown as having a maximum amplitude at $\Theta$=o, a minimum and a phase change at $$\Theta = +\frac{\pi}{2} \text{ and } -\frac{\pi}{2},$$

and maxima again at $\Theta=+\pi$ and $-\pi$. The maximum amplitude of the C.T. output is a function of the driving voltage on the synchros 30 and 31. Transformer 39 provides a reference voltage of constant amplitude and always in phase with the driving voltage as indicated by the curve in FIG. 3 labeled "Transformer 39 output". This voltage is added to the output of the corresponding control transformer, resulting in the curve labeled "Error Signal", which, it will be noted, is of increasing amplitude from $\Theta$=o to $\Theta=+\pi$ and $\Theta=-\pi$. In this manner, as the synchros 30 and 31 deviate either in the clockwise direction or in the counter-clockwise direction from the zero reference position, increasing error signals are produced in the programmer 17 in direct proportion to the angular displacement of the synchro transmitters from o to $\pi$ in either direction. This, of course, is less ambiguous than the normal servo wave form which passes through two maxima and two nulls for each 360° of travel.

The error signals derived as explained in the foregoing are applied to a signal-time comparison circuit in programmer 17, which is the circuit of FIG. 10 of the aforementioned Swanekamp and Wilson application and has been generally designated at 40. It is noted here that no provision has been made in the present circuit to detect a roll condition in the missile. Moreover, since the gyro outer gimbal is in effect journaled in the missile frame structure, the synchros 30 and 31 will interchange in the measurement of pitch and yaw as the missile rolls. For this reason, the dudding limits for the pitch and the yaw directions have been selected to be equal. No attempt has been made, therefore, to distinguish the two conditions as "pitch" and "yaw" in the circuitry 40.

The error signals are applied to the circuit 40 over leads 41 and 42 to the emitter terminals of unijunction transistors 81 and 81', respectively. As can be seen in FIG. 2, the circuit is symmetrical about the ground and for this reason, the elements on one side have been indicated by the same reference numerals as those on the other, except that primes have been applied thereto. A description of one channel will, of course, suffice for both. The input error signal is coupled to the emitter terminal of the unijunction transistor 81, for example, by way of a resistor 86 and a diode 87. The emitter of the unijunction transistor 81 is biased in a forward direction by means of the input error signal and a resistor 92 and a capacitor 91 connected in parallel therewith, both of which are connected to ground. The function of this arrangement is to introduce a filtering and delay function into the error signal as applied to the emitter of the unijunction transistor in order to permit the missile to exceed temporarily the established attitude limits without dudding. This will be described below with respect to FIG. 4.

As is known in the art, the electrical characteristic of a unijunction transistor is such that for a particular base-to-base potential there exists a peak value of emitter potential which must be applied before the transistor can fire and operate in the negative resistance portion of its characteristic. The present circuitry establishes a first base-to-base potential on the unijunction transistors 81 and 81' during a first time interval after the missile is launched after which the base-to-base potential is lowered to a second value during a second time interval up until the arming time delay expires, in order to establish wide limits at the beginning of the flight and narrow limits at the terminal portion of the flight, as mentioned above. To this end, the 60 volt power supply of the missile is applied over lead 58 to an integrating circuit 104 and resistors 63 and 64. The integrating circuit 104 is of the conventional resistance-capacitance type and comprises resistor 105 and condenser 106 connected in series to ground. The output of the integrator circuit is obtained across capacitor 106 and is fed to the emitter terminal 77 of a unijunction transistor 72. One of the base terminals of unijunction transistor 72 is connected to lead 58 by way of resistor 74. The other base terminal is connected to ground by way of resistor 73. The first base terminal is also connected to the cathode of a Shockley diode 65 by way of a coupling capacitor 78. The anode of Shockley diode 65 is connected to resistor 64 and to the resistor 105 of the integrator circuit 104. The cathode of the Shockley diode is also coupled to ground by way of conventional diode 66.

The operation of this portion of the circuitry is as follows. Prior to the application of the 60-volt power to the circuit there will be virtually no charge on capacitor 106 of the integrator circuit 104. Consequently, the voltage between the base and emitter of the unijunction 72 will be small and little current will flow therethrough. After the power is applied at the instant that the missile is launched, capacitor 106 begins to charge and the 9 voltage on the emitter terminal increases until the peak value of the characteristic for the particular base-to-base potential is reached, at which point the unijunction transistor 72 will be rendered conductive. When this occurs, the voltage on terminal 75 will drop because of the current flowing through resistor 74. The resulting negative impulse is coupled to the Shockley diode 65 by way of capacitor 78. Shockley diode 65 was formerly nonconducting, because there was insufficient voltage across it to permit conduction. When the negative impulse produced by the energization of unijunction transistor 72 is fed to the cathode 69 of Shockley diode 65, the resulting voltage across that element will be sufficient to drive it beyond its breakdown voltage. Additional current will accordingly flow through resistors 63 and 64, and the potential of the anode of the Shockley diode will be considerably lowered. With the additional surge of current through resistors 63 and 64, a drop in voltage is suddenly produced on lead 59. Thus, it can be seen that at the initiation of the time interval, when capacitor 106 began to charge, and unijunction transistor 72 and Shockley diode 65 were each in their nonconducting state, a high potential was applied on lead 59 to the unijunction transistors 81 and 81'. This high potential establishes a high characteristic curve for these elements such that it requires a high voltage on the emitter terminals thereof to drive them into conduction. Then, after the time interval established by integrator circuit 104, which is the time interval $t_0$ to $t_1$ in FIG. 4, the actuation of 8 unijunction transistor 72 and Shockley diode 65 is such as to produce a lower base-to-base potential on the unijunction transistors 81 and 81'. This then establishes a lower characteristic and a lower emitter potential will cause them to conduct. This is illustrated by the lower step of the threshold voltage curve as shown in FIG. 4 between times $t_1$ and $t_2$.

Unijunction transistors 81 and 81' are used to trigger a silicon controlled rectifier 96 to provide the dudding signal, The base terminal 97 of unijunction transistor 81 is connected to the control lead 110 of the SCR 96 by way of a diode 94. A shunting resistor 95 may also be provided if desired. SCR 96 is triggered into conduction when either of unijunction transistors 81 or 81' becomes conductive.

The operation of the circuit will now be described with reference to an exemplary flight path of the missile. The threshold curve as shown in FIG. 4 has been described above. The curve labeled "error signal" in FIG. 4 is completely arbitrary and has been drawn to represent possible perturbations of the missile in flight over a typical flight path. As chosen for purposes of illustration, the error signal is initially quite high at time $t_0$. This would be representative of the target bearing with respect to the launching submarine at the moment of launch. The launching submarine is normally not expected to be pointed toward the target. After the missile is launched, it is here assumed that it initially deviates away from the target bearing as shown by the increasing value of the error signal. Such a flight could result from water currents for example. The missile is then shown to recover and begin to approach the target bearing, the error signal decreasing to a minimum point somewhere around $t_1$ as shown. It is then assumed that air currents or some other perturbing influence causes the error to increase again, going up to a second peak, after which the missile again recovers and the error signal again approaches zero. It is apparent that the missile exceeds the threshold limits twice during the course of this flight.

Figure 4:
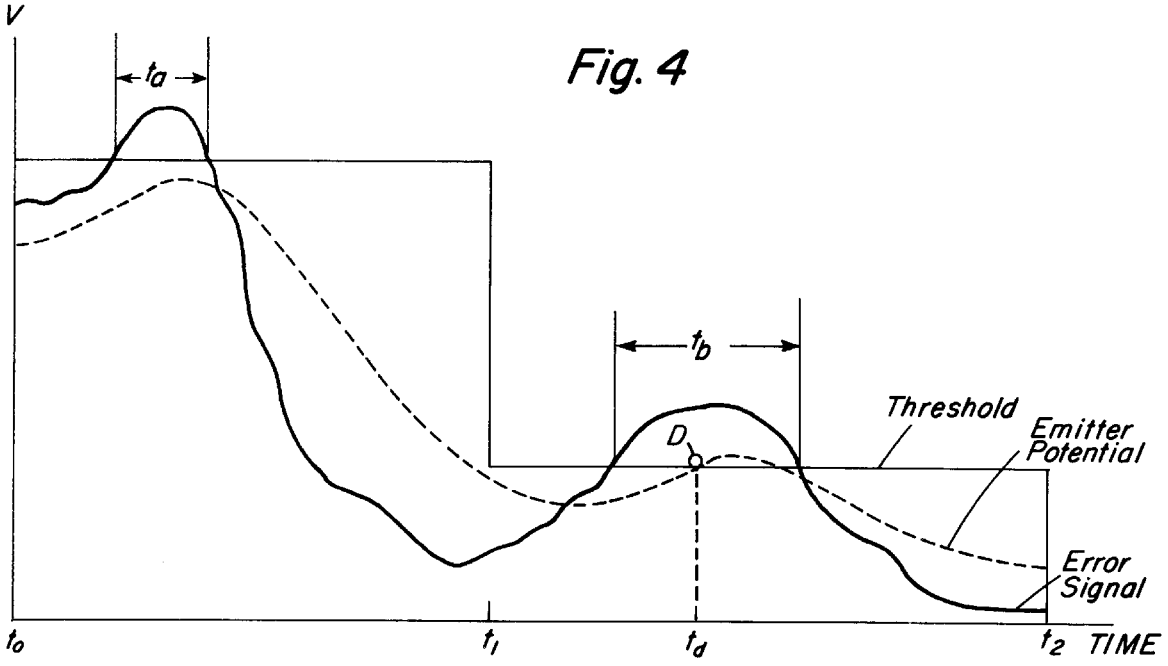

The dashed line curve in FIG. 4 is the emitter potential on one of the unijunction transistors. It is apparent that the capacitor 91 and resistance 86 have smoothed the error signal somewhat and introduced a time delay therein which would be a function of the capacitance 91 and the magnitude of the error signal. Thus, at the first peak of the error signal, which lasts for a time $t_a$ as shown, the emitter potential does not reach the threshold value. Accordingly, the unijunction transistor 81 does not conduct, even through the missile itself has exceeded the established attitude limits at this time. Of course, if the time interval $t_a$ were longer, the capacitor would be allowed more time to charge and might reach the threshold value, at which time the missile would become a dud. For purposes of illustration, the curve has been shown as not reaching the threshold so that the missile flight continues undudded.

At the instant $t_1$, the threshold limits will be lowered. to the lower value. Thus, in the illustrative example of FIG. 4, when the missile flight experiences the second perturbation resulting in the second peak which lasts for a time $t_b$, the threshold limits are lower and a lower error voltage will actuate the unijunction transistor. In the illustration, $t_b$ has been shown as quite long and the delay introduced by capacitor 91 now is shorter than the duration of the perturbation. Accordingly, at the instant that the emitter potential curve crosses the threshold curve, at time $t_d$, the unijunction transistor 81 will be triggered into conduction. The gate lead 110 of SCR 96 will then receive a triggering signal and SCR 96 will conduct to provide the dudding signal. Of course, if the interval $t_b$ were short enough, it is possible that the missile might exceed the threshold limits and recover without dudding, as it did in the first excessive perturbation.

Finally, at the end of the second time interval as indicated at $t_2$ in FIG. 4, the circuit 40 is shut off entirely by the operation of switch $S_1$ by the arming timer 22, as has been described above.

It should now be apparent that an attitude safing system for a missile has been described which meets all of the objects of the invention. The system is simple in that it uses a standard, off-the-shelf two-degree-of-freedom gyro and requires no special mechanical modifications thereof. The system is such that the gyro does not lose its reference orientation when the attitude limits are reached or momentarily exceeded. In addition, the utilization of time delay circuits in the device provides for excursions of the missile past the dudding limits for short durations of time. Safety of a high order is provided in that the dudding limits can be varied to narrow them after a predetermined time so that in the early portions of the flight wider angular deviations are permitted in order to allow the missile to get on course. Finally, the opening of switch $S_1$ after the desired arming delay improves reliability in that the dudding capability of the device is removed when it is no longer needed.

Obviously, many modifications in details will become apparent to those skilled in the art in the light of the above teachings. It is to be understood therefore that within the scope of the appended claims, the invention may be practiced otherwise than as herein specifically described.

What is claimed is:

1. An attitude safing system for a missile having a warhead, comprising a delay arming timer connected to said warhead to arm the same after a predetermined time interval, attitude error sensing means having means coupled thereto for producing an electrical error signal proportional to the attitude error, means responsive to said error signal for producing a dudding signal in the event that said error signal exceeds a predetermined value for a predetermined time, and means responsive to said dudding signal to interrupt the operation of said delay arming timer, whereby if an excessive attitude condition persists, said warhead is prevented from becoming armed.

2. An attitude safing system as recited in claim 1, wherein said attitude error sensing means comprises a two-degree-of-freedom gyro having angular displacement measuring means coupled thereto for producing electrical signals directly proportional to the deviation of said missile from a desired course.

3. An attitude safing system as recited in claim 2, wherein said angular displacement measuring means comprises synchro transmitters coupled to said gyro, control transformers coupled to said synchro transmitters, each of the control transformers having the rotor thereof initially adjusted to a position with respect to the stator thereof such that a voltage of maximum amplitude and 180° out of phase with the driving voltage on the corresponding synchro transmitter is induced in said control transformer rotor when the synchro transmitter rotor is at its zero reference position, and a transformer having a primary winding and a plurality of secondary windings coupled to said control transformers, said primary winding being driven by the same source as said synchro transmitters in order to induce in said secondary windings voltages which are always in phase with the driving voltage and which is constant and equal in magnitude to the maximum voltage obtainable from said control transformer, each of said secondary windings being connected in series additive relationship to the rotor of one of said control transformers, whereby signals are produced which are of zero magnitude when the synchro transmitter rotors are at their respective zero reference positions and increase to maxima when said synchro transmitter rotors move through 180° of angular displacement in either the clockwise or the counterclockwise directions.

4. An attitude safing system as recited in claim 1, wherein said attitude error sensing means is a two-degree-of-freedom gyro having an inner gimbal and an outer gimbal, said error signal producing means comprising a synchro transmitter coupled to each of said gimbals, a control transformer coupled to each of said synchro transmitters, each of said control transformers having the rotor thereof initially adjusted to a position with respect to the stator thereof such that a voltage of maximum amplitude and 180° out of phase with the driving voltage on said synchro transmitter is induced in said control transformer rotor when said synchro transmitter rotor is at its zero reference position, and a transformer having a primary winding and two secondary windings coupled to said control transformers, the primary of said transformer being driven by the same source as said synchro transmitter in order to induce a voltage in said secondaries which is always in phase with said driving voltage, the induced voltage being constant and equal in magnitude to the maximum voltage obtainable from said control transformers, each of the secondaries of said transformer being connected in series additive relationship to the rotor of one of said control transformers, whereby the resulting error signal is of zero magnitude when said synchro transmitter rotor is at its zero reference position and increases to a maximum when said synchro transmitter rotor moves through 180° of angular displacement in either the clockwise or counterclockwise directions.

5. An attitude safing system as recited in claim 1 further comprising, means operative on said means for producing a dudding signal for changing said predetermined value, whereby the dudding limits may be adjusted to be large during the early portion of the flight of the missile to allow for vigorous maneuvering and turns, and narrow after a predetermined time to provide for greater safety.

6. An attitude safing system as recited in claim 5 further comprising, means responsive to said delay arming timer for disabling said means for producing a dudding signal after said delay arming timer has achieved a predetermined state, whereby the reliability of the missile is increased by preventing dudding of said warhead after it has been armed.

7. An attitude safety arming system for a missile having a warhead, comprising an electrically operated delay arming timer connected to said warhead to arm the same after a predetermined time interval, switch means for controlling the application of electrical energy to said timer, a two-degree-of-freedom gyro in said missile, said gyro having its spin axis oriented so as to be horizontal in the pitch plane of said missile and directed toward the target in the yaw plane of said missile, synchro transmitters coupled to said gyro and connected to a source of a.c. voltage for producing electrical signals representative of the pitch and yaw of said missile, a control transformer coupled to each of said synchro transmitters, each control transformer having the rotor thereof initially adjusted to a position such that the voltage induced therein is of maximum amplitude and 180° out of phase with respect to the driving voltage on the respective synchro transmitter when the rotor thereof is in its zero reference position, transformer means connected to said source of a.c. voltage for producing voltages of constant magnitude equal to the maximum obtainable from said control transformers and in phase with said driving voltage at all times, said transformer means being coupled to said control transformers so as to add said voltages of constant magnitude to the induced voltages in said control transformers whereby error voltages directly proportional to angular displacements of said missile are obtained, circuit means responsive to said error signals for producing a dudding signal when any of said error signals exceeds a predetermined value for a predetermined time period, said switch means being responsive to said dudding signal to interrupt the flow of electrical energy to said timer, whereby said warhead cannot become armed if said dudding signal occurs prior to the expiration of said predetermined time interval.

* * * * *